US005310229A

United States Patent [19]

Hanson

[11] Patent Number: 5,310,229

[45] Date of Patent: May 10, 1994

[54] ICE EMERGENCY AID AND RECOVERY METHOD INCORPORATING SAME

[76] Inventor: David C. Hanson, 31 Doninion Road, Apartment #2, Etobicoke, Ontario M8W 1J5, Canada

[21] Appl. No.: 19,487

[22] Filed: Feb. 19, 1993

[51] Int. Cl.[5] ..... B63C 9/32

[52] U.S. Cl. ..... 294/26; 294/61; 30/164.7; 441/82

[58] Field of Search ..... 294/25, 26, 61, 167, 294/5; 441/82; 30/164.5, 164.6, 164.7, 164.8, 143

[56] References Cited

U.S. PATENT DOCUMENTS

| | | | |
|---|---|---|---|
| 66,557 | 7/1867 | Bidgins | 30/164.8 |
| 2,651,840 | 9/1953 | Taylor | 30/164.5 X |
| 3,752,524 | 8/1973 | Reick, Jr. | 294/25 |
| 3,995,902 | 12/1976 | Sciaino, Jr. | 294/5 |
| 4,002,366 | 1/1977 | Hammes | 294/26 |
| 4,020,551 | 5/1977 | Lundquist | 294/26 X |
| 4,815,997 | 3/1989 | Forsmark et al. | 294/26 X |
| 4,893,408 | 1/1990 | Mattingly et al. | 30/143 X |
| 5,209,685 | 5/1993 | Hammes | 294/26 X |

*Primary Examiner*—Dean J. Kramer
*Attorney, Agent, or Firm*—Bereskin & Parr

[57] ABSTRACT

An emergency aid is provided along with a recovery method incorporating same for use by a person who has fallen through the surface of a frozen body of water. The aid includes a pair of support elements that each have a hand grip. Each support element includes at least one tooth for limiting lateral movement of the element relative to the ice surface. The support elements are releasably connected together along a common axis. In first and second embodiments of the invention, a bore is defined in at least one of the hand grips for receiving a corresponding portion of the other hand grip. In a third embodiment of the invention a collar surrounds both hand grips. The recovery method comprises the steps of accessing the emergency aid, disconnecting the support elements, thrusting the teeth of the support elements into the ice surface, and pulling upon the hand grips to move oneself onto the ice surface.

10 Claims, 5 Drawing Sheets

ICE EMERGENCY AID AND RECOVERY METHOD INCORPORATING SAME

FIELD OF THE INVENTION

The invention pertains to the field of safety devices, and in particular to an ice emergency aid and method for use by a person who has fallen through the surface of a frozen body of water.

BACKGROUND OF THE INVENTION

Every year a number of people are killed by falling through the surface of a frozen body of water and drowning in the freezing waters below. These tragedies most frequently occur to snowmobilers, skaters, skiers, ice fisherman, and pedestrians crossing the ice surface. Often the victims are unable to pull themselves from the water onto the ice surface because the ice surface lacks any rigid protrusions that may be gripped.

There is a need for an aid that may be carried by persons who are travelling along an ice surface. The aid would provide means for gripping the ice surface to assist a person in pulling themselves onto the ice surface. The aid would be convenient and safe to carry and would be simple to access when a person has fallen through the ice.

SUMMARY OF THE INVENTION

In a first aspect, the invention provides an ice emergency aid for use by a person who has fallen through the surface of a frozen body of water, comprising:

(a) a pair of support elements;

(b) a hand grip located on each of said support elements, said hand grip having a first and a second end;

(c) engaging means located on each of said support elements for engaging the surface of the frozen body of water; and (d) connecting means located on at least one of said support elements for releasably connecting said support elements together.

In a second aspect, the invention comprises a recovery method for use by a person who has fallen through the surface of a frozen body of water, said method comprising the steps of:

(a) accessing an ice emergency aid having a pair of support elements that are releasably connected by connecting means, each said support element having a hand grip and engagement means for engaging the surface of the frozen body of water;

(b) disconnecting said support elements;

(c) thrusting said engagement means of at least one of said support elements into the surface of said frozen body of water; and (d) pulling upon said hand grip of said at least one support element to move oneself onto the surface of said frozen body of water.

BRIEF DESCRIPTION OF THE DRAWINGS

For a better understanding of the present invention, and to show more clearly how it may be carried into effect, reference will now be made, by way of example, to the accompanying drawings. The drawings show preferred embodiments of the present invention, in which.

DETAILED DESCRIPTION OF THE PREFERRED EMBODIMENT

Figure 1:
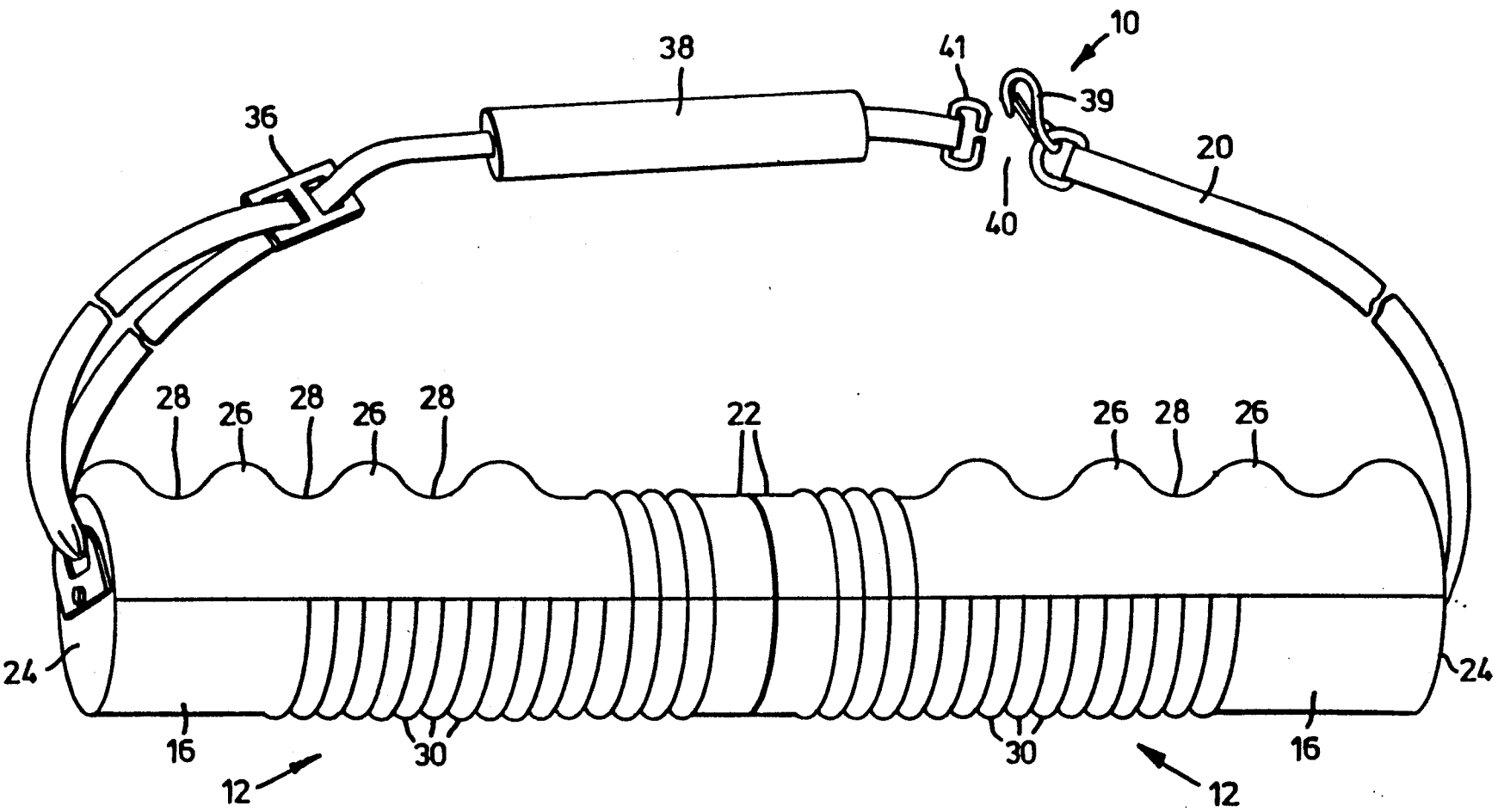
FIG. 1 is a perspective view of a first embodiment of an emergency aid in accordance with the invention with the support elements connected.
Figure 2:
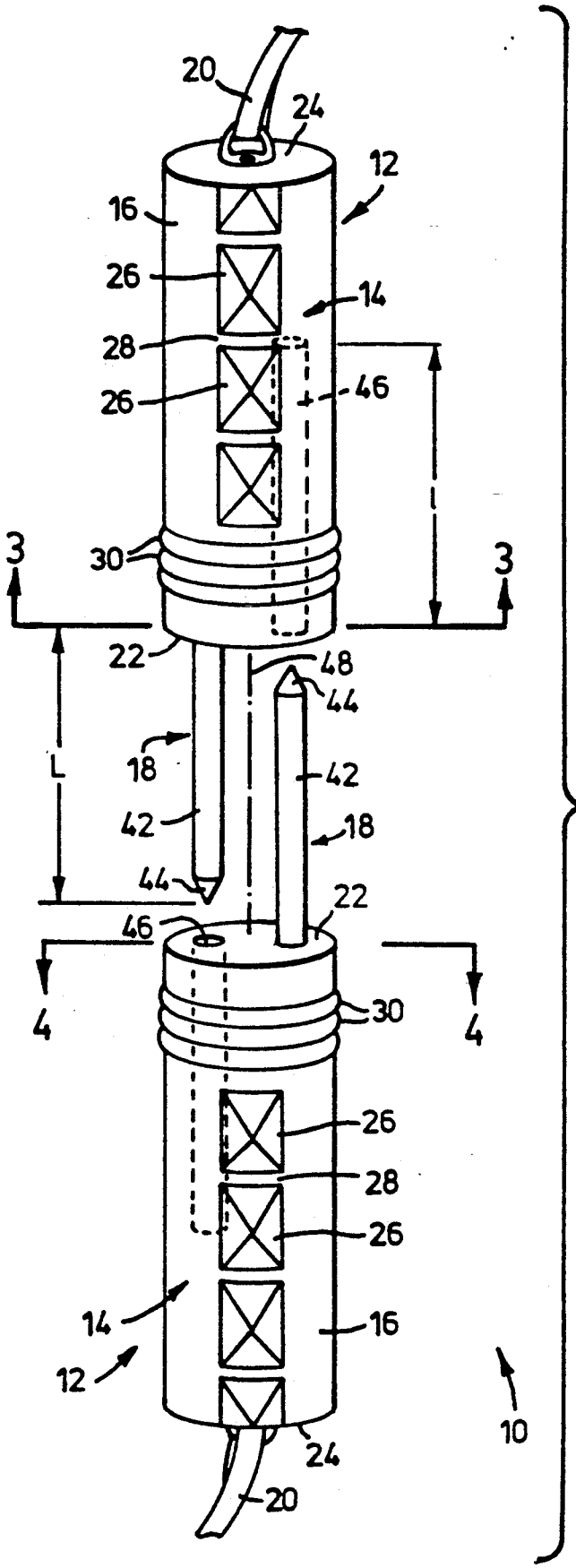
FIG. 2 is a partial, perspective view of the emergency aid depicted in FIG. 1, with the support elements disconnected.
Figures 3, 4:
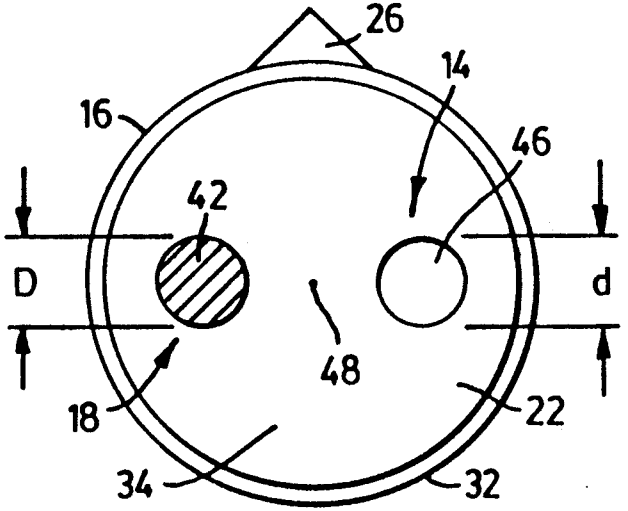
FIG. 3 is a sectional view of a support element taken along line 3—3 in FIG. 2.
FIG. 4 is a sectional view of a support element taken along line 4—4 in FIG. 2.

An ice emergency aid in accordance with the present invention is shown generally at 10 in the Figures. The emergency aid 10 includes a pair of support elements shown generally at 12. A connecting means for releasably connecting the support elements 12 together is shown generally at 14. Each of the support elements 12 has a hand grip 16 and an engaging means shown generally at 18. A strap 20 is also provided to assist carrying the aid 10.

The support elements 12 connect together when not in use to minimize the overall size of the aid 10 and to improve its portability. Also, the engaging means 18 of the support elements 12 are preferably covered when the support elements 12 are connected to reduce the likelihood of the engaging means 18 causing injury or damage to a person's body or clothing when the aid 10 is being carried. When a person carrying the aid 10 falls through an ice surface, the support elements 12 may be manually disconnected from each other and thrust into the ice surface to assist the person in pulling himself onto the ice surface.

The hand grip 16 for each support element 12 is typically circular in cross-section and includes first and second ends 22 and 24. A series of raised portions 26 are located upon the circumference of the hand grip 16 to define between them a series of finger holds 28. The finger holds 28 are provided to receive a person's fingers and reduce the tendency of the person's hand slipping from the hand grip 16 during emergency use. To further discourage slippage, a series of ridges 30 may be located about at least a portion of the circumference of the hand grip 16.

The emergency aid 10 is preferably buoyant in water and luminous. This is best accomplished by constructing the hand grip 16 from the selected materials described below.

The hand grip 16 may be constructed of one or two pieces. A two-piece hand grip 16 is depicted in the Figures and has an outer skin 32 and an inner core 34. The outer skin 32 is constructed from a luminous material, such as a phosphoric plastic, to enable the hand grip 16 to be visible in a dark environment. Thus, the hand grip 16 should be visible in the evening or in the darkness of water. A one-piece hand grip could be painted with a phosphoric paint. The inner core 34 of the two-piece hand grip 16 (or the entire one-piece hand grip 16) is constructed from a buoyant material, such as a lightweight foam, to cause the support elements 12 to float in water. This is useful if the support elements 12 are dropped while a person is hurriedly trying to free himself from the water.

The strap 20 includes a conventional slider 36 to allow the strap 20 to be adjusted along its length. A soft sleeve 38 may also be provided to make the aid 10 more comfortable to carry. A releasable joint 40 is located on the strap 20 to permit the strap 20 to be severed when the aid 10 needs to be quickly accessed. The joint 40 may be formed from a snap hook 39 attachable to a flexible broken ring 41. When the tension of the strap 20 exceeds a critical amount, the flexible ring 41 will release the snap hook 39 to sever the strap 20.

The aid 10 can be carried with the strap 20 extending behind a person's neck and the connected elements 12 resting against the person's chest. Of course, the aid 10 may be carried around a person's waist or in a variety of other ways instead.

The engaging means 18 is provided to limit relative movement between the support element 12 and the ice surface so that a person may pull themselves from the water onto the ice surface. The engaging means 18 and connecting means 14 may take a variety of forms, and examples are described below with reference to specific embodiments of the invention. For convenience, like numerals are referenced to like components.

Referring to FIGS. 1–4, a first embodiment of the invention is depicted. As shown, the engaging means 18 includes a shaft 42 extending from the first end 22 of the hand grip 16. One end of the shaft 42 is rigidly imbedded in the inner core 34 of the hand grip 16 by conventional means. A tooth 44 is located at the free end of the shaft 42. The tooth 44 limits lateral movement of the support element 12 relative to the ice surface. As shown, a single tooth 44 is provided. The tooth 44 is sufficiently sharp to become imbedded into the ice surface when the support element 12 is manually thrust tooth first at the ice surface. The tooth 44 may include a plurality of serrations (not shown) to improve its ability to engage the ice surface.

The connecting means 14 of the first embodiment includes a bore 46 defined in each hand grip 16 and offset from the grip axis 48. The bore 46 opens at the first end 22 of each hand grip 16. The bore 46 has a length l corresponding to the combined length L of the shaft 42 and tooth 44 extending from the other hand grip 16. Also, the bore 46 has a diameter d that is slightly greater than the diameter D of the corresponding shaft 42 and tooth 44. The bore 46 is thus dimensioned to snugly receive the engaging means 18 (shaft 42 and tooth 44) of the corresponding other hand grip 16. The snug relationship between the bore 46 and the engaging means 18 is such that the support elements 12 remain connected until they are manually disconnected by pulling the hand grips 16 apart.

Figure 5:
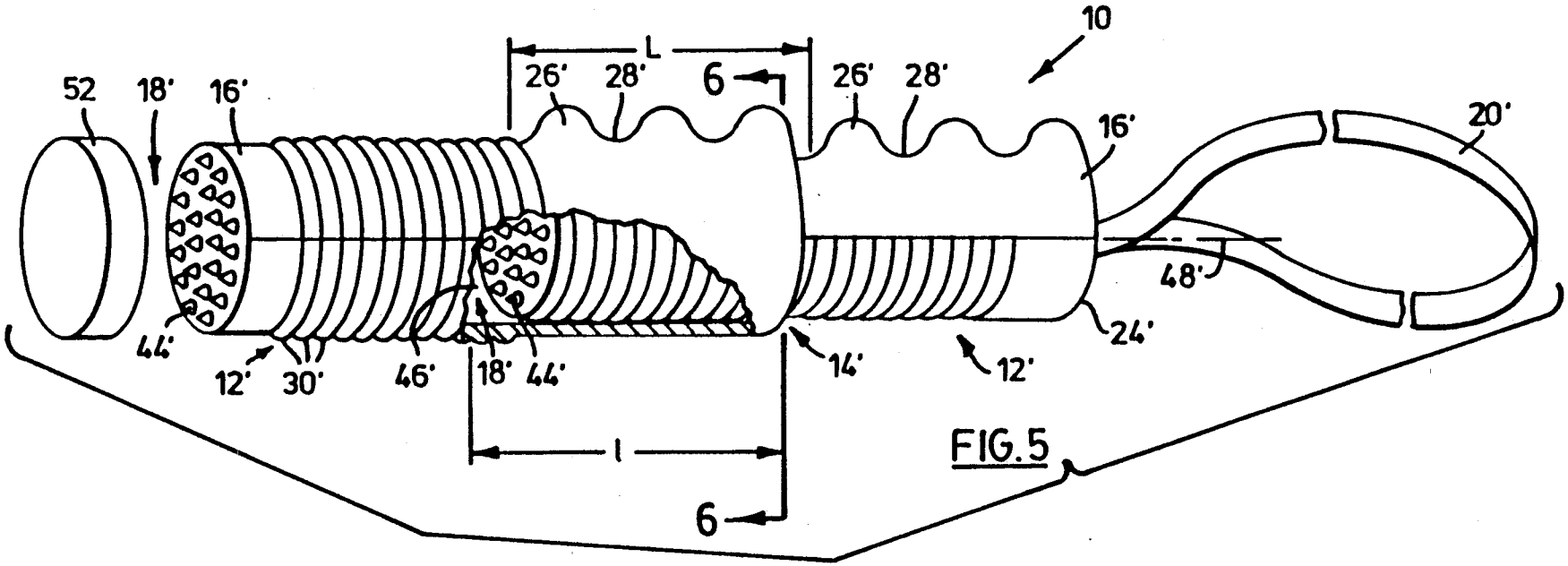
FIG. 5 is an exploded, perspective view of a second embodiment of an emergency aid in accordance with the invention with the support elements connected and a portion broken away to show the connecting elements.
Figure 6:
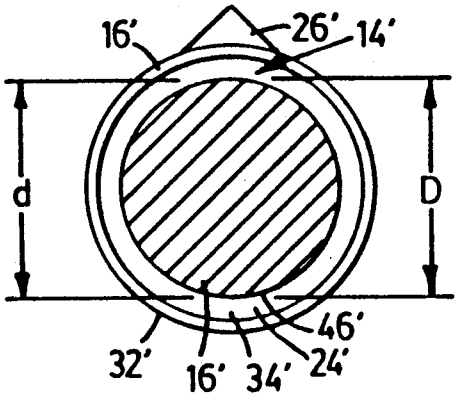
FIG. 6 is a sectional view of the emergency aid taken along line 6—6 in FIG. 5.

Referring to FIGS. 5 and 6, in which primed reference numerals indicate parts corresponding to those of FIGS. 1 to 4, a second embodiment of the invention is depicted. As shown, the engaging means 18' includes a plurality of teeth 44' extending from the surface of the first end 22' of the hand grip 16'.

The connecting means 14' of the second embodiment includes a bore 46' defined along the grip axis 48' of the hand grip 16'. The bore 46' is defined in only one of the hand grips 16' however, and opens at its second end 24'. The bore 46' has a length l corresponding to the length L of a portion of the other hand grip 16 extending between its, second end 24' and the first raised portion 26'. The bore 46' has a diameter d' that is slightly greater than the diameter D' of the above-described portion of the other hand grip 16'. The bore 46' is thus dimensioned to snugly receive the portion of the other hand grip 16' in a telescoping relationship. The snug relationship is such that the support elements 12' remain connected until they are manually disconnected by pulling the hand grips 16' apart. A cap 52 is provided to cover the engaging means 18' of the hand grip 16' containing the bore 46'. The cap 52 protects the engaging means 18' from injuring a person's clothing or body when the emergency aid 10' is being carried. A strap 20', as described earlier, is fastened to the second end 24 of the hand grip 16 not containing the bore.

Figure 7:
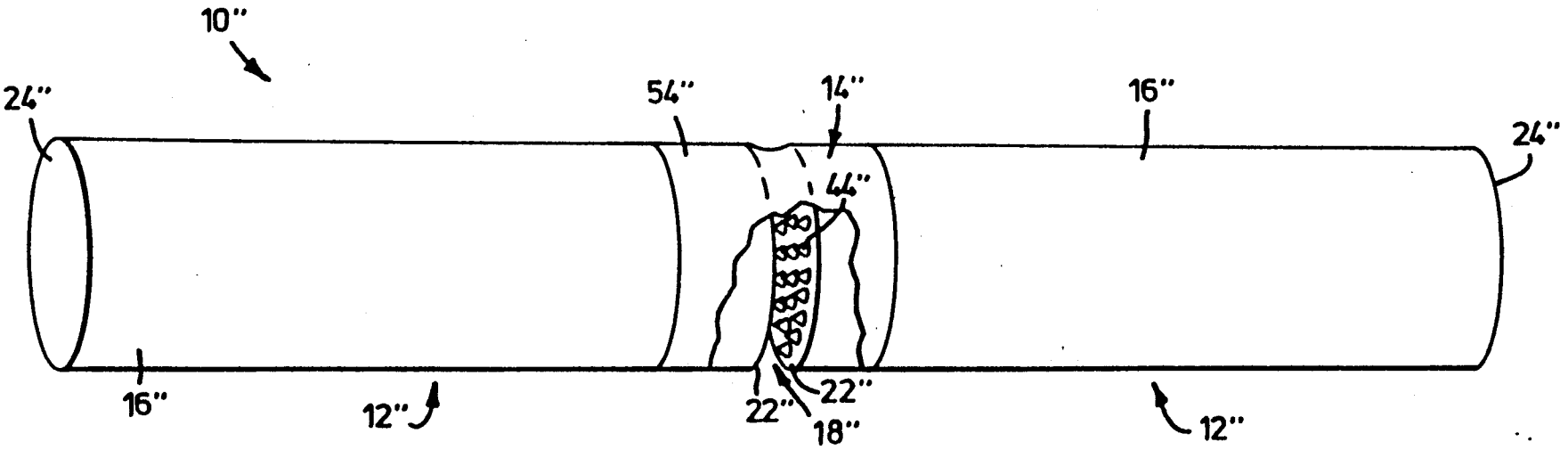
FIG. 7 is a perspective view of a third embodiment of an emergency aid in accordance with the invention with the support elements connected and a portion broken away to show the connecting elements.

Referring to FIG. 7, in which double primed reference numerals indicate parts corresponding to those of FIGS. 1 to 4, a third embodiment of the invention is depicted. Similar to the second embodiment, the engaging means 18" includes a plurality of teeth 44" that extend directly from the surface of the first end 22" of the hand grip 16.

The connecting means 14" of the third embodiment consists of a collar 54 that extends about the circumference of both hand grips 16" to hold the elements together. The collar 54 may be formed from tape or it may be formed from plastic and shrunk over the hand grips 16" to hold them in place. Alternatively, the collar 54 may be constructed of cloth or another sturdy material and secured with a releasable fastener such as a hook-and-loop fastener. Preferably, the collar 54 is constructed such that the elements may be disconnected by applying a torsional force to each of the hand grips 16' until the connection with the collar 54 is severed.

In operation, the ice emergency aid 10 could be used as follows. A person intending to travel along an ice surface would strap the emergency aid 10 to their body. If such a person were to fall through the ice surface, he would access the emergency aid 10 and disconnect the support elements 12. The person would then thrust the engagement means 18 of one or both of the support elements 12 into the ice surface and pull upon the hand grips 16 to pull himself out of the water onto the ice surface. Typically, the person would thrust and pull upon one support element 12 and then the other in a sequential fashion to advance themselves upon the ice surface.

It is to be understood that what has been described are preferred embodiments of the invention. The invention nonetheless is susceptible to certain changes and alternative embodiments fully comprehended by the spirit of the invention as described above, and the scope of the claims set out below.

I claim:

1. An ice emergency aid for use by a person who has fallen through the surface of a frozen body of water, comprising:

(a) a pair of support elements each having a first end and a second end;

(b) a hand grip located on each of said support elements;

(c) engaging means located on said first end of each of said support elements for engaging the surface of the frozen body of water, said engaging means comprising at least one tooth;

(d) connecting means located on said first ends of said support elements for releasably connecting said support elements together along a common axis with said first ends of said support elements facing one another so that said support elements when connected together form a single axially extending unit; and (e) a strap fastened to at least one of said support elements and forming a closed loop for carrying said aid by said person, said strap including a releasable joint for permitting severance of said strap, to enable said person to grip said hand grips as a unit in one hand and sever said strap, so that said person can then separate said support elements and then engage the surface of the frozen body of water with said engaging means.

2. An ice emergency aid as claimed in claim 1, wherein said connecting means comprises a bore defined in at least one of said support elements, said bore being dimensioned to snugly receive a portion of the corresponding said support element.

3. An ice emergency aid as claimed in claim 2, wherein said engaging means includes a shaft extending from said first end of said hand grip and terminating in said at least one tooth.

4. An ice emergency aid as claimed in claim 3, wherein said bore is located in each of said hand grips, and wherein said bore opens at said first end of said hand grip to snugly receive said engaging means of the corresponding said support element.

5. An ice emergency aid for use by a person who has fallen through the surface of a frozen body of water, comprising:

(a) a pair of support elements each having a first and a second end;

(b) a hand grip located on each of said support elements;

(c) engaging means located on said first end of each of said support elements for engaging the surface of the frozen body of water, said engaging means comprising an elongated tooth;

(d) connecting means located on said first ends of said support element for releasably connecting said support elements together along a common axis with said first ends of said support elements facing one another, said connecting means comprising a bore defined in each of said first ends of said support element, said bore of each support element being adapted to snugly receive at least a portion of the elongated tooth of the other support element in a telescoping relationship, said support elements when connected together forming a single axially extending unit;

(e) a strap fastened to said second end of each of said support elements to form, when said first and second support elements are assembled together, a closed loop with said first and second support elements, said strap including a releasable joint for permitting severance of said closed loop, to enable said person to grip the aid in one hand and sever said loop, so that said person can then separate said support elements and engage said engaging means with said surface of the frozen body of water.

6. An ice emergency aid as claimed in claim 5, wherein at least said hand grips are constructed from a material that is buoyant in water.

7. An ice emergency aid as claimed in claim 6, wherein at least said hand grips are constructed from a luminous material.

8. An ice emergency aid for use by a person who has fallen through the surface of a frozen body of water, comprising:

(a) a pair of support elements;

(b) a hand grip located on each of said support elements, said hand grip having a first and second end, and said hand grip being constructed from luminous and buoyant materials;

(c) engaging means located on each of said support elements for engaging the surface of the frozen body of water, said engaging means including at least one tooth;

(d) a bore defined in one of said hand grips for releasably connecting said support elements together, said bore opening at said second end of said hand grip to snugly receive a portion of the other support element in a telescoping relationship, said portion including said engaging means;

(e) a strap fastened to at least one of said support elements to form a closed loop for carrying said aid, said strap including a releasable joint for permitting severance of said strap; and (f) a cap for covering said at least one tooth of said one of said hand grips.

9. A recovery method for use by a person who has fallen through the surface of a frozen body of water, said method comprising the steps of:

(a) accessing an ice emergency aid having a pair of support elements each having a hand grip and each having a first and second end, each support element having at said first end engagement means for engaging the surface of the frozen body of water, said first ends of said support elements being releasably connected together along a common axis by connecting means to form a single axially extending unit, said emergency aid further having a strap fastened to said second end of each of said support elements, said strap forming with said support elements and when said support elements are assembled together, a closed loop, said strap having a releasable joint for permitting severance of said loop, said loop being hung around the neck of said person;

(b) pulling on said loop to sever said loop at said releasable joint;

(c) disconnecting said support elements;

(d) thrusting said engagement means of at least one of said support elements into the surface of said frozen body of water; and (e) pulling upon said hand grip of said at least one support element to move said person onto the surface of said frozen body of water.

10. A recovery method as claimed in claim 9, wherein steps d and e are employed with one of said support elements and then the other said support element in a sequential fashion to advance the person onto the ice surface.

* * * * *